United States Patent [19]

Brunette

[11] 3,933,102

[45] Jan. 20, 1976

[54] DISPLAY RACK EXTENSION

[76] Inventor: Frederick F. Brunette, 22804 Brookdale, Farmington, Mich. 48024

[22] Filed: Sept. 23, 1974

[21] Appl. No.: 508,230

[52] U.S. Cl. ..... 108/111; 248/250

[51] Int. Cl.[2] ..... A47B 3/00

[58] Field of Search ..... 108/47, 59, 92, 96–98, 108/101, 107, 110, 111; 211/176, 177; 248/223–225, 235, 247, 249, 250

[56] References Cited

UNITED STATES PATENTS

| | | | |
|---|---|---|---|
| 1,598,849 | 9/1926 | Colby | 108/92 X |
| 2,244,995 | 6/1941 | Klaasen | 248/224 X |
| 2,534,682 | 12/1950 | Robishaw | 211/177 |
| 3,194,528 | 7/1965 | Chesley | 248/250 |

*Primary Examiner*—James C. Mitchell

*Attorney, Agent, or Firm*—Gifford, Chandler & Sheridan

[57] ABSTRACT

A display rack extension having an elongated vertical leg and an elongated horizontal shelf support secured at its center to the upper end of the vertical leg and generally perpendicular thereto. A locking member is carried at the lower end of the vertical leg to secure the rack extension to the upper end of an upright support of a display rack.

3 Claims, 4 Drawing Figures

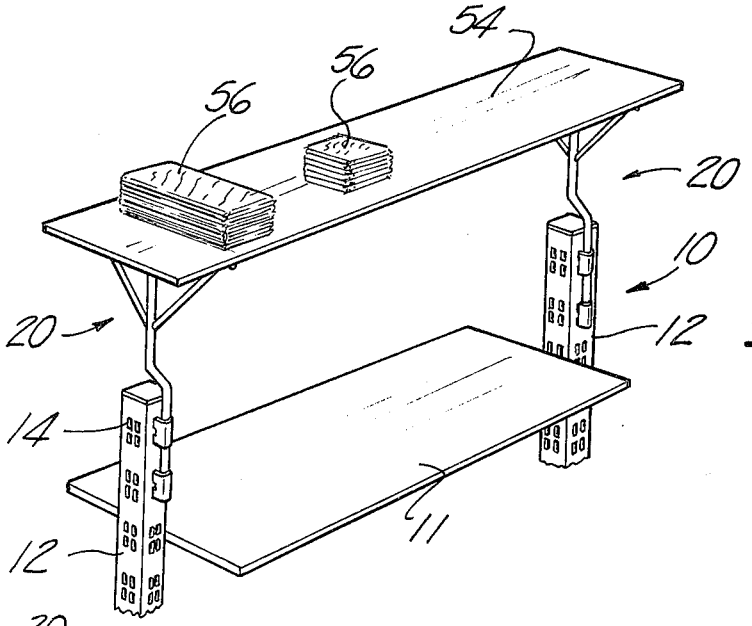
Fig-1
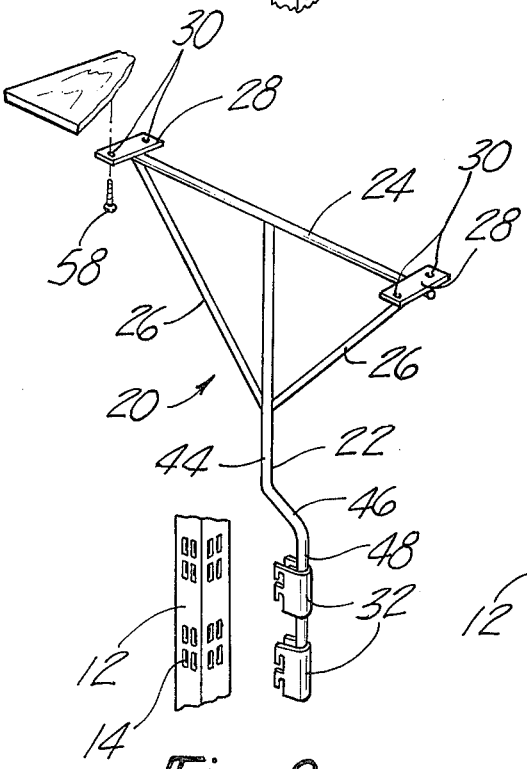
Fig-2
Fig-3
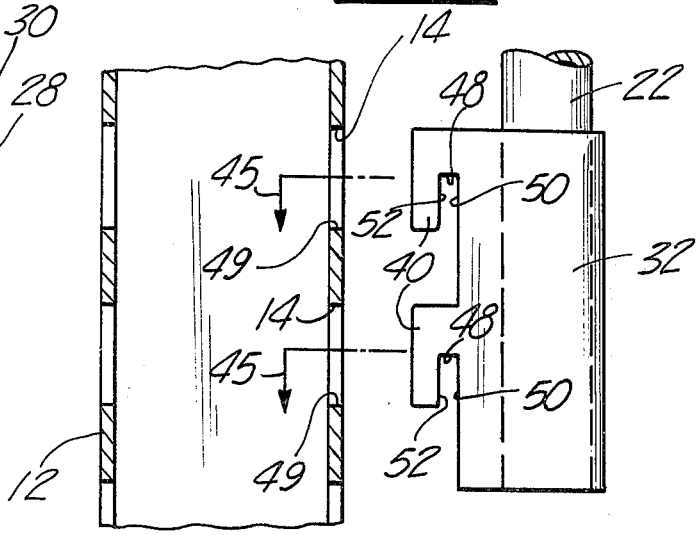
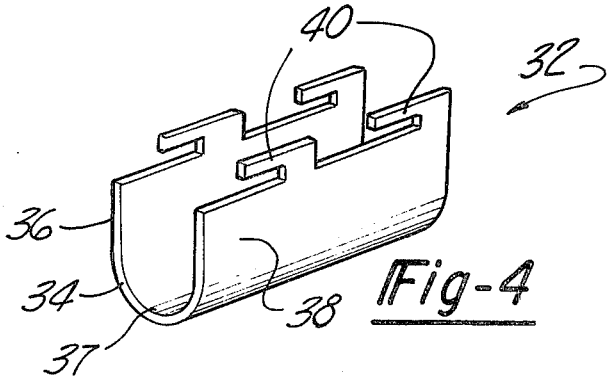
Fig-4

DISPLAY RACK EXTENSION

BACKGROUND OF THE INVENTION

1. Field of the Invention

The present invention relates to the art of display devices and more particularly to a display rack extension having a horizontal shelf support secured at its center to the upper end of the vertical leg of a display rack for supporting a shelf on both sides of the vertical leg of the display rack extension.

2. Prior Art

Display racks, having a pair of spaced upright supports, have become quite commonplace in retail outlets throughout the United States. The upright supports generally support a number of shelves therebetween which are adapted to display merchandise.

The display rack thus far described has enjoyed great commercial success and has been generally accepted by retailers for displaying their wares and goods. The display racks, however, do suffer the disadvantage that the space above the display rack is generally wasted. Since space in a retail outlet is not only limited but also expensive, a number of display rack extensions have been previously known to extend or increase the height of the display rack.

One form of previously known display rack extensions typically takes the form of a right angle shelf support. One end of the right angle support attaches to the upper end of the upright support for the display rack so that the lower leg of the extension is generally vertical while the upper leg of the rack extension is horizontal and forms a support for a shelf in an elevated position above the display rack. It will be appreciated that two rack extensions are normally required for each display rack, i.e. one extension per upright support.

The previously known display rack extensions suffer many disadvantages unknown to the present invention. Primarily, the previously known extensions are unstable and a slight jolt to the display rack often results in merchandise falling to the floor. Falling merchanise not only damages the merchandise but also presents a safety hazard to the retailer's customers.

Previously known display rack extensions also have had a tendency to sag downwardly due to the weight of merchandise on the shelf thereby causing the merchandise to drop to the floor and resulting in the same abovementioned problems.

SUMMARY OF THE PRESENT INVENTION

The present invention overcomes the above mentioned disadvantages of the previously known display rack extensions by providing a T-shaped rack extension. The vertical segment of the "T" of the extension attaches to the top of the display rack upright support by hooks in a conventional fashion. The upper horizontal shelf support, unlike previously known rack extensions, is adapted to support a shelf or shelves on both transverse sides of the vertical leg of the T-shaped rack extension. The dual shelves, i.e. a shelf on each side of the vertical leg of the extension, not only adds rigidity to the rack extension, but in addition the weight of the shelf plus its merchandise on one side of the vertical leg of the rack extension counterbalances the weight of the shelf plus its merchandise on the other side of the vertical leg of the rack extension thereby eliminating the aforementioned sagging of the prior art rack extensions and the subsequent problems of falling merchandise.

The rack extension of the present invention preferably includes a number of cross pieces between the horizontal shelf support and the vertical leg of the rack extension to further increase the rigidity of the rack extension.

BRIEF DESCRIPTION OF THE DRAWING

The display rack extension of the present invention will be more clearly understood by reference to the following detailed description when read in conjunction with the accompanying drawing, wherein like reference characters refer to like parts throughout the several views, and in which:

FIG. 1 is an elevated side perspective view of the showing the rack extension of the present invention assembled onto a display rack;

FIG. 2 is an elevated side perspective view of the rack extension of the present invention with parts broken away and enlarged for clarity;

FIG. 3 is an enlarged, partial cross-sectional view showing the locking means of the present invention; and FIG. 4 is an enlarged perspective view showing the locking means of the present invention.

DETAILED DESCRIPTION OF THE PREFERRED EMBODIMENT

As shown in FIG. 1, a display rack 10 is shown comprising a pair of vertical spaced upright supports 12 adapted to support a number of shelves 11 therebetween in any conventional manner. The upright supports 12 are elongated and typically constructed of square tubular metal so that each upright support 12 has four sides. At least one side of the upright support 12 includes a number of elongated slots 14 therethrough in spaced parallel pairs so that the longitudinal axis of the slots 14 is substantially parallel to the longitudinal axis of the upright supports 12. Numerous shelves 11 may, of course, be attached between the upright supports 12 and the retailer's merchandise is then placed on the shelves 11 for display.

As can best be seen in FIG. 2, the rack extension 20 of the present invention generally comprises a vertical leg 22 and an upper horizontal shelf support 24. Both the vertical leg 22 and the shelf support 24 are preferably constructed of metal rods although other materials and construction may be used without deviating from the spirit of the present invention.

The vertical leg 22 is joined at its upper end to the center of the shelf support 24, preferably by welding, so that the vertical leg 22 is generally perpendicular to the shelf support 24. Two cross members 26 are fastened between the outer ends of the shelf support 24 and below the center of the vertical leg 22 to rigidly hold the horizontal shelf support 24 to the vertical leg 22. The cross members 26 are also preferably welded to the shelf support 24 and the vertical leg 22 although other fastening means, such as screws or the like, may also be used. The cross members 26 may also be of integral construction with each other thereby forming a single V-shaped cross piece.

Still referring to FIG. 2, a small and generally rectangular plate 28 is welded or otherwise fastened to the upper surface of the shelf support 24 on each end thereof so that the top surface of the plate 28 lies substantially in a horizontal plane. Each plate 28 preferably has a pair of apertures 30 therethrough, one aperture on each side of the junction between the plate 28 and the shelf support 24, so that a shelf may be secured to the rack extension 20 in a manner to be later described.

Two locking members 32 for attaching the rack extension 20 to the display rack upright supports 12 are fastened, again preferably by welding, to the lower end of the vertical leg 22 with one locking member disposed above the other. The locking member 32, as best shown in FIG. 4, is generally in the form of a U-shaped channel 34 having parallel sides 36 and 38 and a base 37 intermediate the sides. Preferably the inner radius of the channel base 37 is substantially the same as the outer radius of the rack extension vertical leg 22 so that the channel base 37 snugly fits around the vertical leg 22 with the elongated portion of the base 37 disposed around the vertical leg 22. With the channel base 37 thus positioned around the vertical leg 22, the two sides 36 and 38 of the U-shaped channel 34 protrude out from the periphery of the vertical leg 22 and the sides 36 and 38 form a pair of vertically disposed parallel flanges. In the preferred embodiment, the plane of the flanges formed by the sides 36 and 38 is substantially parallel to the plane defined by the vertical leg 22 and the horizontal shelf support 24.

Each side 36 and 38 includes a pair of hooks 40 as an integral part of the side 36 or 38. The hooks 40 and the two locking members 32, are spaced between each other and spaced along the rack extension of the vertical leg 22 so that all eight hooks 40, i.e. four hooks on both the top and bottom locking member 32 will register with eight slots 14 in the display rack upright support 12.

In the preferred embodiment, the vertical leg 22 of the rack extension 20 is bent above the upper locking member 32 to form an upper vertical segment 44, an angled middle segment 46, and a lower vertical segment 48 of the vertical leg 22 which is parallel to, but offset from, the upper segment 44 of the vertical leg 22. The purpose of the angled segment 46 of the vertical leg 22 will now be described in conjunction with the operation and construction of the present invention.

To assemble the display rack extension of the present invention, the hooks 40 on the locking members 32 are inserted into receiving slots 14 on the front or rear of the upright supports 12 of the display rack 10, and then pushed downward as shown by arrows 45 in FIG. 3 until the inner edge 48 of the hook 40 abuts against the bottom 49 of the respective slot 14. The side of the upright support 12 is thus firmly locked between edges 50 and 52 of the hooks 40. A second rack extension 20 is fastened in a similar manner to the other upright support 12. The angled segment 46 of the rack extension vertical leg 22 serves to maintain the upper segment 44 of the rack extension vertical leg 22 in alignment with the vertical upright support 12 to both increase the stability of the rack extension 20 and to enhance its beauty.

An upper shelf 54 is then placed upon the four plates 28 on the ends of the two shelf supports 24 and firmly secured thereto by screws 58 through apertures 30. It will be appreciated that other means may be utilized to secure the shelf 54 to the plates 28, particularly if the shelf 54 is constructed of a fragile material, such as glass. Merchandise 56, or the like, may then be placed on the shelf 54 for display.

It will also be appreciated that the shelf 54 can be attached to the extensions 20 prior to attaching the hooks 40 to the upright supports 12.

As thus described, the rack extension of the present invention distributes all the weight on the top shelf 54 across both sides of the rack extension vertical leg 22 thereby eliminating the disadvantageous sagging of the previously known display rack extensions. In addition, due to the widely displaced four point support for the shelf 54, the present invention achieves stability unknown in previous rack extensions.

It should also be understood that although the present rack extension has been described as functional in conjunction with a display rack, the present invention is not limited to such use. Rather the rack extension of the present invention may be used to support a shelf above a cash register, counter, or in any other desired elevated position.

Having thus described my invention, many modifications and alterations thereto will be apparent to those skilled in the art to which the invention pertains without departing from the spirit of the invention as defined by the scope of the appended claims.

What is claimed is:

1. The combination of a display rack and a display rack extension, said display rack having spaced and vertical upright supports, said supports having a plurality of sides, at least one of said sides being provided with vertically spaced slots, said display rack extension comprising spaced and vertical legs, said legs being spaced to coincide with said supports, hooked portions carried on said legs for engaging said upright supports of said display rack through said slots to lock said display rack extension to said supports whereby said display rack extension is disposed above said display rack, a shelf support secured to the upper ends of said vertical legs, and a shelf carried by said shelf support in a horizontal position above said display rack and said vertical legs each having an angled portion providing a lower segment having said hooked portion and an upper segment carrying said shelf support, said upper segment being offset from said lower segment by said angled portion by an amount which positions the axis of said upper segment substantially co-axial with the axis of said support of said display rack whereby said shelf is supported directly above said supports.

2. The combination as defined in claim 1 and in which said shelf support comprises a pair of plates carried at the upper end of each of said vertical legs.

3. The combination as defined in claim 2 and including a support rod extending horizontally between each of said pairs of plates and a cross member extending downwardly from each end of said support rod with the opposite end thereof being secured to a corresponding one of said vertical legs.

* * * * *